United States Patent [19]

Levin

[11] 4,171,629

[45] Oct. 23, 1979

[54] STOP MOTION FOR KNITTING MACHINES

[76] Inventor: Nathan Levin, 416 Highgate Dr., Trenton, N.J. 08618

[21] Appl. No.: 885,528

[22] Filed: Mar. 10, 1978

[51] Int. Cl.[2] ..... D04B 35/12

[52] U.S. Cl. ..... 66/161; 200/61.13

[58] Field of Search ..... 66/157, 161, 163, 158, 66/160; 200/61.13, 61.14, 61.18; 242/36; 318/6; 57/80

[56] References Cited

U.S. PATENT DOCUMENTS

| | | | |
|---|---|---|---|
| 3,713,308 | 1/1973 | Levin | 66/163 |
| 3,726,113 | 4/1973 | Levin et al. | 66/163 |
| 3,795,120 | 3/1974 | Levin | 66/163 |
| 3,851,501 | 12/1974 | Levin et al. | 66/161 X |

*Primary Examiner*—Werner H. Schroeder

*Assistant Examiner*—A. M. Falik

[57] ABSTRACT

A new latch box for stop motion apparatus for knitting machines of the type wherein the stop motion acts to automatically stop the machine when there is an undesirable amount of excess tension in the yarn being fed to the machine. The new latch box is of non-electrically conductive material and cooperates fully with the other parts of the apparatus as completely as the replaced latch box. A trigger is added to the new latch box in addition to its latch. Both the latch and the trigger are under the control of the yarn feeding arm of the apparatus in such manner that when there is excess yarn tension the trigger is actuated before the latch is actuated thereby to actuate the stop motion to stop the machine sooner than it would be stopped by the prior art latch boxes.

10 Claims, 6 Drawing Figures

STOP MOTION FOR KNITTING MACHINES

Figure 1:
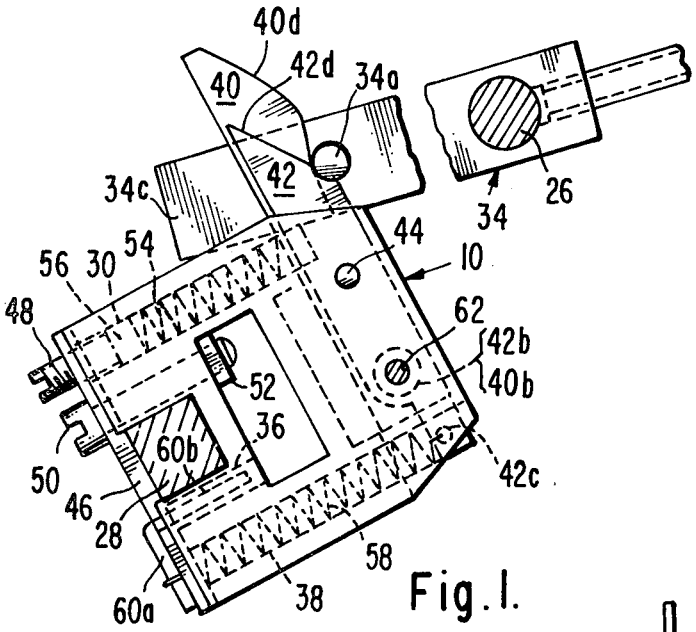

The present invention relates generally to the art of knitting and more particularly to yarn actuated stop motions for knitting machines wherein the stop motion first acts to automatically stop the machine when there is an undesirable amount of excess tension in the yarn being knitted, and which then acts, in turn, to automatically reset itself and to automatically re-start the machine.

The present invention is for an improvement in the stop motion disclosed in the U.S. Pat. to Levin, No. 3,713,308, to which attention is directed for an understanding thereof. The improvement is in the structure of a portion of the stop motion apparatus, and in earlier actuation of the stop motion to stop the machine sooner.

As identified in the Levin patent, there is a 'control box 30' with a 'latch 32' therein. The present invention provides a new control box of novel formation to replace the control box 30 of the Levin patent. The new control box is provided with a latch (similar to the aforesaid latch 32) and with an additional member referred to as a "trigger", by means of which the stop motion of the Levin patent can be actuated earlier to stop the machine sooner.

It is the principal object of the present invention to provide a control box of novel formation for the stop motion embodying the principle of the invention set forth in the Levin patent, and to provide means for earlier actuation of such stop motion to stop the machine sooner.

Figure 2:
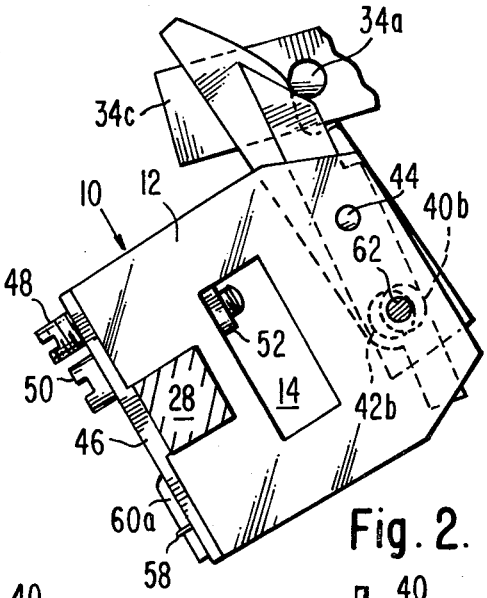
Figure 3:
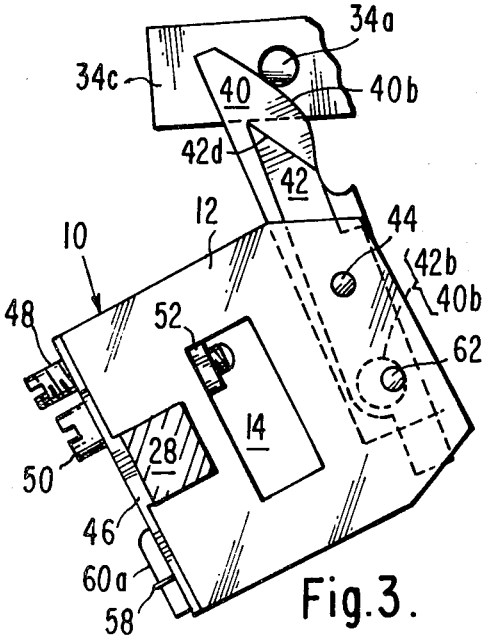
Figure 4:
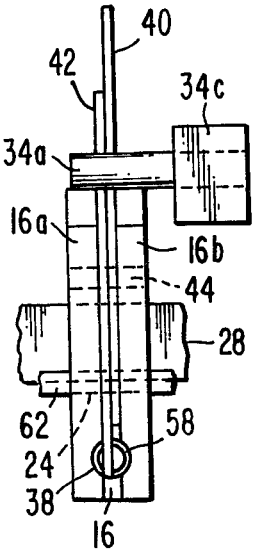
Figure 5:
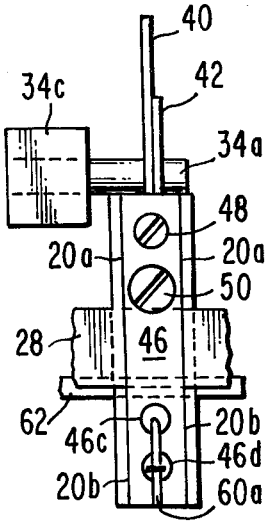
Figure 6:
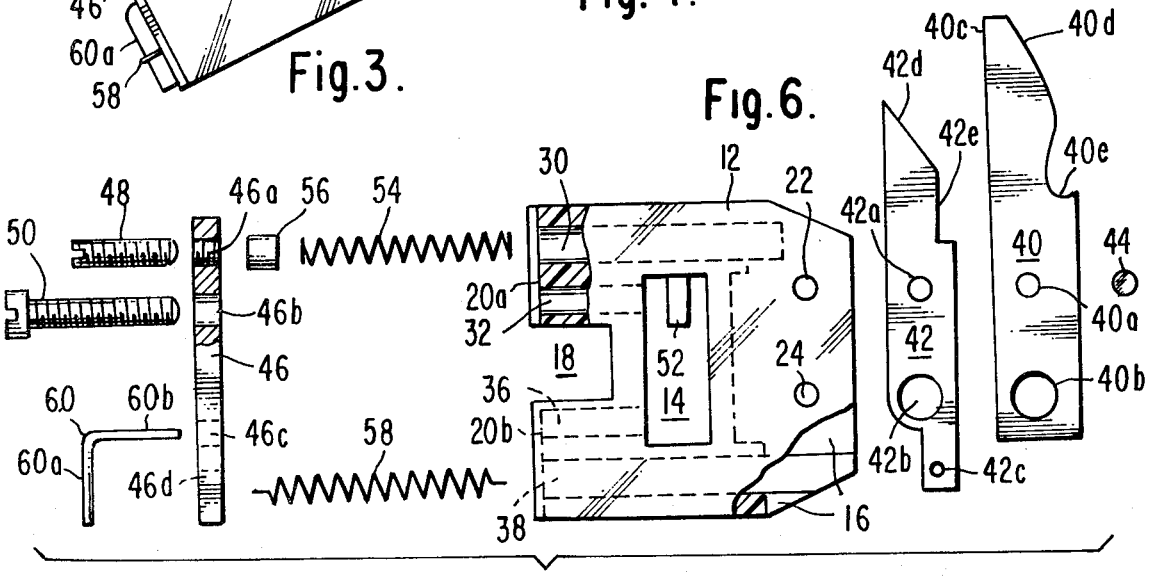

In the drawings:

FIG. 1 is a side elevational view of the control box of the present invention in place in relation to some of the apparatus of the Levin patent, the box containing a latch in its latched position and a trigger in its off position, FIG. 2 is a view generally similar to FIG. 1 with the trigger in its on position and with the latch still in its latched position, FIG. 3 is a view generally similar to FIG. 2 with the trigger still in its on position and with the latch in its unlatched position, FIG. 4 is a front elevational view of the control box of FIG. 1, FIG. 5 is a rear elevational view of the control box of FIG. 1, and FIG. 6 is an exploded view of the elements of the control box of the present invention.

Certain parts of the Levin patent are shown in FIGS. 1-5 of the present drawings. These parts, numbered the same as they are numbered in the patent, are shaft 26, support bar 28, a portion of yarn arm 34, and pin **34*a* projecting from handle 34*c* of the yarn arm. The control box 30 and latch 32 of the patent, are replaced by a control box 10 and a latch 40**, respectively, of the present invention, and the latter are shown in their relation to the aforementioned parts of the patent.

Each control box 10 of the present invention (one per feed) is positioned upon support bar 28 in suitably spaced relation to its neighbors. As in FIG. 6, the box has a housing 12 of non-electrically conductive material, such as plastic. The housing, of generally rectangular box-like shape, is provided with a central aperture 14 extending transversely therethrough, a central slot 16 extending along its front end, a square shaped slot 18 extending transversely through its rear end, spaced shallow grooves **20*a*, 20*b* extending along its rear end on both sides of slot 18, spaced circular openings 22, 24 extending transversely through both walls 16*a*, 16*b* formed by slot 16, and lengthwise extending bores 30, 32, 36, 38, with bore 30 extending between groove 20*a* and slot 16, with bores 32, 36 extending between grooves 20*a*, 20*b* and aperture 14, and with bore 38 extending from groove 20*b*** fully through the housing.

A latch 40 and a trigger 42 having upper apertures **40*a* and 42*a*, respectively, are pivotally supported in side by side relation within slot 16 of the housing upon a pin 44 extending through apertures 40*a*, 42*a* and through aperture 22 in walls 16*a*, 16*b* of the housing. The pin extends freely through the latch and the trigger is self-frictioned in the walls. The latch and trigger, which are of a length to extend unequally above the housing, are also provided with lower apertures 40*b* and 42*b*, respectively, such being spaced from apertures 40*a*, 42*a* and being larger than and being axially aligned with aperture 24 of the housing, for a purpose to be set forth. Latch 40 is provided at its upper end with a curved face 40*d* which extends from a notch 40*e*, while trigger 42 is provided at its upper end with an angled face 42*d* which extends from a straight face 42*e***.

A rectangular plate 46 is received in slots **20*a*, 20*b* while spanning slot 18. The plate has spaced apertures 46*a*, 46*b*, 46*c* and 46*d* in alignment with bores 30, 32, 36 and 38, respectively. An adjusting screw 48 is in threaded engagement with and extends through aperture 46*a* into bore 30. A screw 50 extends freely through aperture 46*b* and bore 32 into threaded engagement with a nut 52 positioned within aperture 14. Tightening of screw 50 not only holds plate 46 securely in grooves 20*a*, 20*b*, but it also holds control box 10 securely on support bar 28 when the bar is received within slot 18 of the control box. The width of slot 18 is slightly greater than the corresponding dimension of bar 28 so that the latter is readily received within the slot. The depth of slot 18, however, is slightly less than the corresponding dimension of bar 28 so that when screw 50 is tightened, plate 46 frictionally engages bar 28 and holds control box securely in place at any desired position along the bar. The sidewalls of grooves 20*a*, 20*b* position plate 46** and restrain it against lateral movement.

A suitable compression spring 54, followed by a plug 56, are freely received within bore 30 between rear edge **40*c* of the latch 40 and screw 48. Adjustment of this screw will correspondingly adjust the spring tension on the latch to urge it in clockwise direction, FIG. 1. The force of compressed spring 54 will also be exerted against plate 46. Trigger 42 is narrower than the latch so spring 54 exerts pressure only upon the latch. A suitable tension spring 58 is freely received within bore 38 with one end anchored in aperture 42*c* of the trigger and with the other end extending freely through aperture 46*d* of the plate to be anchored on one arm 60*a* of a right angle pin 60 the other arm 60*b* of which extends freely through aperture 46*c* of the plate and freely into bore 38 of the housing. The force of tensioned spring 58 will also be exerted against plate 46. A rod 62 of electrically conductive material and of indefinite length extends through each of the apertures 24 in turn of the spaced control boxes positioned on bar 28. When the latch is in its latched position and the trigger is in its off position, FIG. 1, rod 62 is spaced from electrical contact with the surrounding interior walls of apertures 40*b*, 42*b* of the latch and of the trigger. When the latch is in its latched position and the trigger is in its on position, FIG. 2**, rod 62 is in electrical contact with the interior wall of aperture 42*b* of the trigger and is spaced from electrical contact with the interial wall of aperture 40*b* of the latch. When the latch is in its unlatched position and the trigger is in its on position, FIG. 3, rod 62 is in electrical contact with the walls of both apertures 42*b* and 40*b* of the trigger and of the latch, respectively. The arrangement of the parts and of the materials thereof are such that electrical contact is maintained between bar 28, plate 46, pin 60, spring 58 and trigger 42. Also, between bar 28, plate 46, screw 48, plug 56, spring 54 and latch 40. It will also be noted that the latch and the trigger are in electrical contact. Bar 28 and rod 62 are each separately connected to the stop motion (not shown) so that when there is an electrical connection across the bar and the rod, via either the trigger or the latch, the stop motion is actuated to stop the machine.

In operation, FIG. 1. spring 54 urges latch 40 against pin 34*a* with the latter in notch 40*e* of the latch. At the same time, spring 58 urges face 42*e* of trigger 42 against the pin. Thus yarn arm 34 is held in its operative position by the latch at the same time that the latch is held in its latched position and the trigger is held in its off position by the pin and wherein rod 62 does not contact either the latch or the trigger. As the yarn arm is caused to turn clockwise from its position of FIG. 1 to its position of FIG. 2, about shaft 26, by excessively tensioned yarn, the pin moves upwardly out of notch 40*e*, relative to the latch and to the trigger, to a position in which it still continues to hold the latch but releases the trigger. The released trigger, under the influence of spring 58, turns so that contact is made between rod 62 and the interior wall of its aperture 42*b*, to actuate the stop motion and to stop the machine. As the yarn arm turns further from its position of FIG. 2 to that of FIG. 3, pin 34*a* moves further upwardly to a position in which it ceases to hold the latch in its latched position. The latch, under the influence of spring 54, turns so that contact is made between rod 62 and the interior wall of its aperture 40*b*. If contact between rod 62 and the trigger should not stop the machine, then subsequent contact between rod 62 and the latch will provide a second, but later, opportunity to stop the machine. The movement of the latch and the trigger about pin 44 is limited by rod 62 in their apertures 40*b* and 42*b*, respectively. Surface 42*e* of the trigger does not restrict upward movement of pin 34*a*.

As the arm 34 is returned to its position of FIG. 1 from that of FIG. 3, by means shown in the Levin patent, pin 34*a*, of handle 34*c*, comes into contact with curved face 40*d* of the latch and then with angled face 42*d* of the trigger to turn the latch and the trigger about pin 44 to their positions of FIG. 1 in which the latch is once again in its latched position and the trigger is once again in its off position and in which both are spaced from rod 62.

If it should be so desired, the present control box may be used with only the latch and without the trigger (and its associated parts) in which case the machine will not be stopped, as when using the trigger, but will be stopped no sooner than in the Levin patent by contact of the latch with the rod 62.

While the trigger acts to stop the machine only a very short time sooner than the latch does, it results in a lesser amount of yarn being knitted during the period of the stopping operation itself (from the time the trigger acts to the time the machine comes to a stop). Accordingly, a lesser amount of slack yarn need be available for use by the machine during the period of its stopping operation. Such slack yarn is the yarn available for knitting once the yarn arm is turned by excessively tensioned yarn. Therefore, the yarn arm may be shortened, or the angle through which it turns may be lessened to accordingly decrease the amount of the slack yarn available. The reduced amount of slack yarn needed with the present invention may vary from machine to machine depending upon the amount of yarn normally used per feed to knit a course of fabric, upon the speed of the machine, and upon the efficiency of the machine in coming to a stop. With a shorter and lighter yarn arm 34, its handle 34*a* (which acts as a counterweight for the arm) may be made lighter thereby to provide a yarn arm having less inertia to be overcome when the arm is turned by the excessively tensioned yarn. Shorter slack yarns are less likely to become tangled.

The aforementioned Levin patent is for an improvement over U.S. Pat. No. 3,726,113.

I claim:

1. In a stop motion apparatus for a knitting machine of the type wherein the apparatus has a latch box and a support for the same, the improvement in said apparatus wherein the latch box has a housing of non-electrically conductive material, wherein a latch is pivotally mounted in said housing so as to be movable between latched and unlatched positions, wherein a first spring is received in said housing in operative relation to said latch to move the same to its unlatched position, and means separate from said housing to releasably secure said latch box to said support, said means at the same time serving as an anchor for said first spring, the said latch, the said first spring; the said means, and the said support being formed of electrically conductive material and being so arranged that said latch is in electrically conductive relation to said support via said first spring and said means.

2. Improvement as in claim 1 wherein said support is a bar of rectangular cross section, wherein said housing is provided with a rectangular shaped slot, wherein said bar is received in said slot, wherein the depth of said slot is less than the corresponding dimension of said bar, and wherein said means includes a plate releaseably clamped to said housing with said bar interposed between and in engagement with said plate and said housing.

3. Improvement as in claim 2 wherein a screw is threadedly received in said plate for movement therethrough, wherein said screw is operatively related to said first spring to energize the same, and wherein the force exerted by said energized first spring is transmitted to said plate.

4. Improvement as in claim 1 wherein a rod of electrically conductive material is received in and extends through said housing, wherein said rod and said latch are disposed so that said rod is in contact with said latch when the latter is in its unlatched position, and wherein said rod is spaced from said latch when the latter is in its latched position.

5. Improvement as in claim 4 wherein said latch is provided with an aperture and wherein said rod extends through said aperture in said latch.

6. Improvement as in claim 1 wherein a pivotally mounted trigger of electrically conductive material is also received in said housing, wherein said trigger and said latch are mounted in side by side relation upon a common axis, wherein said trigger is movable between on and off positions, wherein a second spring of electrically conductive material is also received in said housing in operative relation to said trigger to move the same to its on position, said means at the same time also serving as an anchor for said second spring; the said trigger, the said second spring, the said support, and the said means being so arranged that said trigger is in electrically conductive relation to said support via said second spring and said means; and the said trigger, the said latch, the said first spring, the said means and the said support being so arranged that said trigger is also in electrically conductive relation to said support via said latch, said first spring and said means.

7. Improvement as in claim 6 wherein said apparatus has means acting commonly upon said latch and said trigger to hold the latch in its latched position and at the same time to hold the trigger in its off position, wherein said commonly acting means first acts to release said trigger thereby to permit said second spring to move the same to its on position, and wherein said commonly acting means thereafter acts to release said latch thereby to permit said first spring to move the same to its unlatched position, whereby electrical relationship between said trigger and said support is established before electrical relationship is established between said latch and said support.

8. Improvement as in claim 6 wherein a rod of electrically conductive material is received in and extends through said housing, wherein said rod and said trigger are disposed so that said rod is in contact with said trigger when the latter is in its on position and wherein said rod is spaced from said trigger when the latter is in its off position.

9. Improvement as in claim 8 wherein said trigger is provided with an aperture and wherein said rod extends through said aperture in said trigger.

10. Improvement as in claim 6 wherein a rod of electrically conductive material is received in and extends through said housing, wherein said rod and said latch and said trigger are disposed so that said rod is in contact with said latch when the latter is in its unlatched position and is also in contact with said trigger when the latter is in its on position, and wherein said rod is spaced from said latch when the latter is in its latched position and is also spaced from said trigger when the latter is in its off position.

* * * * *